US009568245B2

(12) United States Patent
Kuo et al.

(10) Patent No.: US 9,568,245 B2
(45) Date of Patent: Feb. 14, 2017

(54) HEATING FURNACE

(71) Applicant: CHROMA ATE INC., Tao-Yuan (TW)

(72) Inventors: Hsiu-Wei Kuo, Tao-Yuan (TW); Xin-Yi Wu, Tao-Yuan (TW); Ben-Mou Yu, Tao-Yuan (TW); Ming-Chang Wu, Tao-Yuan (TW); Mao-Sheng Liu, Tao-Yuan (TW); Kuei-Wen Lien, Tao-Yuan (TW)

(73) Assignee: CHROMA ATE INC., Tao-Yuan (TW)

( * ) Notice: Subject to any disclaimer, the term of this patent is extended or adjusted under 35 U.S.C. 154(b) by 120 days.

(21) Appl. No.: 14/681,093

(22) Filed: Apr. 8, 2015

(65) Prior Publication Data

US 2015/0323257 A1 Nov. 12, 2015

(30) Foreign Application Priority Data

May 9, 2014 (TW) ..... 103116573 A

(51) Int. Cl.
*F27B 17/00* (2006.01)
*F27B 1/08* (2006.01)
*F27D 7/04* (2006.01)

(52) U.S. Cl.
CPC ..... *F27B 1/08* (2013.01); *F27B 17/0083* (2013.01); *F27D 7/04* (2013.01); *F27D 2007/045* (2013.01)

(58) Field of Classification Search
CPC ..... F26B 21/02; F27B 17/0083; C21D 1/767
USPC ..... 432/162, 161, 176, 189, 190, 196, 199, 432/201, 203, 217, 253, 258, 261
See application file for complete search history.

(56) References Cited

U.S. PATENT DOCUMENTS 3,905,760 A * 9/1975 Johansson ..... A21B 1/26 126/21 A
4,717,340 A * 1/1988 Wiech, Jr. ..... F27B 17/0083 432/199
4,722,683 A * 2/1988 Royer ..... F24C 15/325 126/21 A
4,927,358 A * 5/1990 Tamura ..... B29C 35/0227 156/285
5,906,855 A * 5/1999 Persson ..... A21B 1/44 126/41 A
6,693,263 B2 * 2/2004 Nishimura ..... B23K 1/012 219/615
2003/0111459 A1 6/2003 Nishimura
2008/0116621 A1 * 5/2008 Brennan ..... F27B 9/10 264/606

FOREIGN PATENT DOCUMENTS

JP 2003225761 A 8/2003

* cited by examiner

*Primary Examiner* — Gregory A Wilson
(74) *Attorney, Agent, or Firm* — CKC & Partners Co., Ltd.

(57) ABSTRACT

The disclosure discloses a heating furnace including a housing, a first rack, a chamber, and at least one fan. The first rack is disposed in the housing. The chamber is disposed in the housing and located at a side of the first rack. The chamber includes an inlet, a first sidewall, and a second sidewall. The first sidewall is adjacent to the first rack. The first sidewall has a plurality of vents. The first sidewall and the second sidewall are disposed to face each other. A width is spaced between the first sidewall and the second sidewall, and the width is larger than or equal to 200 mm. The fan is disposed in the housing for generating an airflow to the inlet.

8 Claims, 1 Drawing Sheet

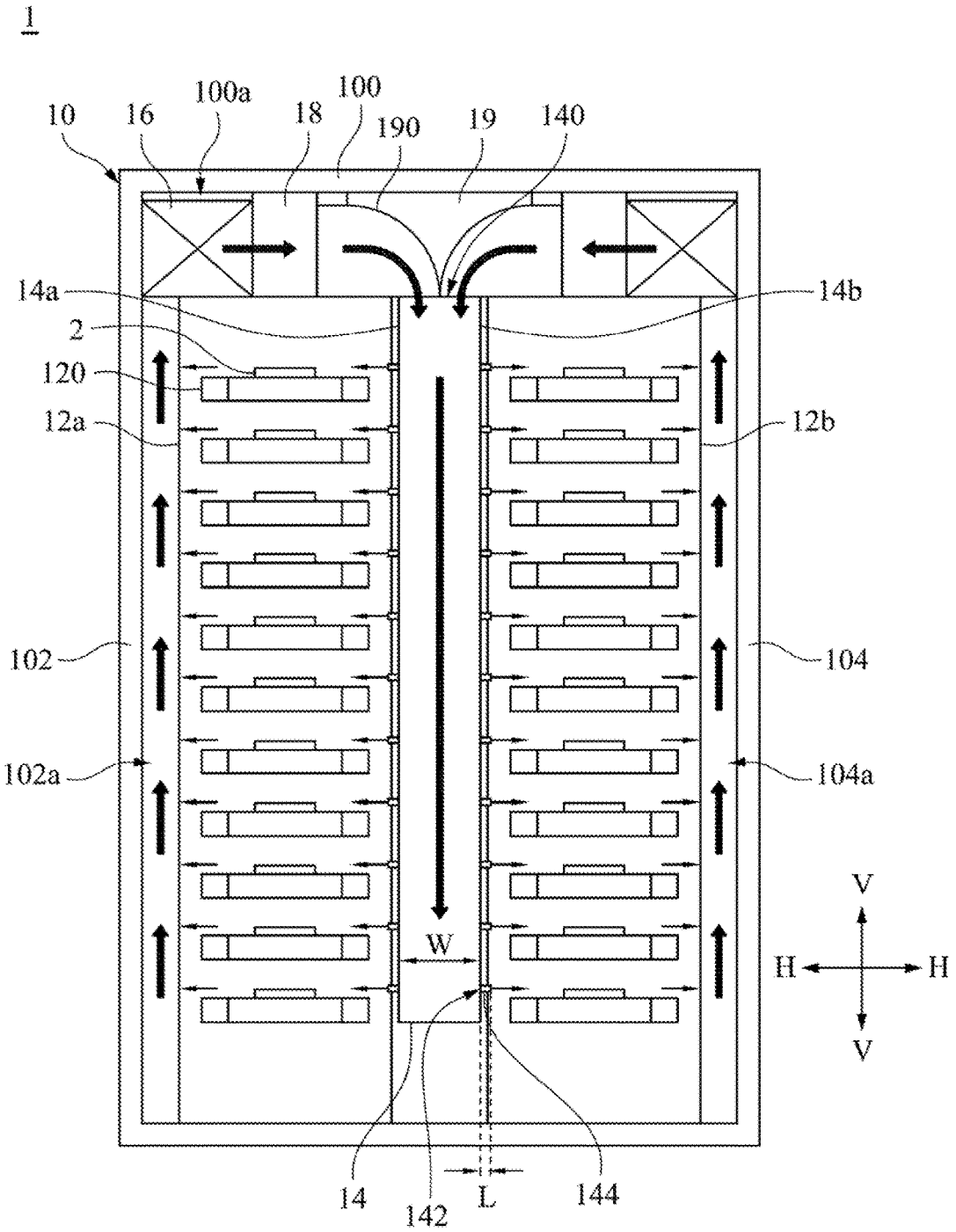
1
10
16
100a
18
100
190
19
140
14a
14b
2
120
12a
12b
102
104
102a
104a
W
V
H
H
V
14
142
L
144

HEATING FURNACE

RELATED APPLICATIONS

This application claims priority to Taiwan Application Serial Number 103116573 filed May 9, 2014, which is herein incorporated by reference.

BACKGROUND

Technical Field

The present disclosure relates to a heating furnace.

Description of Related Art

Nowadays, industry heats or cools objects utilizing a furnace (e.g., a semiconductor heating furnace, a LCD aging test machine, a dryer, an oven, etc.) according to use requirements. The purpose of heating the objects in the furnace typically is to test or dry the objects. The operations of heating the objects substantially is to place the objects, such as DUTs (Device Under Test) or objects to be dried, in the compartment of the furnace, to form a plurality of vents on the side board of the compartment, and to make a blower to blow heated hot air into the compartment via the vents, so as to provide a high-temperature environment to the objects to perform the operations of testing or drying. Whether the objects are in an average-temperature operating environment is also related to the wind velocity, so the operation quality will be influenced if wind velocities at different layers or different places in the furnace are set to be different.

As present, for a conventional heating furnace, after hot air is blown into the compartment, wind velocities at different layers of the compartment are often different. For example, the wind velocities at lower layers are larger than that at upper layers. The situation places DUTs at different operating environments for testing, in such a way that the testing results may easily have errors.

In order to solve this problem, another conventional heating furnace is equipped with wind control structures. A base plate having a plurality of vents is disposed at a side of the compartment of the furnace, and each of the vents is installed with a converging plate of which the angle can be bent to adjust. Each of the converging plates has a plurality of holes. Therefore, by bending the converging plates, the angles of the converging plates can be adjusted to control the wind velocities of air passing through the vents, so as to make the wind velocities at different layers and places be the same.

However, in order to achieve the flow field control mechanism, the wind control structures of the foregoing heating furnace must include numerous converging plates having complex structures and a horn-shaped wind guider, and a special air return way must be designed in the furnace, so the foregoing heating furnace is expensive. Moreover, in order to obtain the same wind velocity at all of the vents, a user must manually adjust angles of the converging plates individually, and must measure whether the wind velocities at the vents are the same by using a precision instrument after adjusting, which disturbs the user a lot.

Accordingly, how to provide a heating furnace that has simple structure and does not need to be manually adjusted to keep different layers and places in the furnace at the same wind velocity and thus keep the objects at an average-temperature operation environment becomes an important issue to be solved by those in the industry.

SUMMARY

In order to solve the foregoing problem, the disclosure provides a heating furnace.

The disclosure provides a heating furnace that includes a housing, a first rack, a chamber, and at least one fan. The first rack is disposed in the housing. The chamber is disposed in the housing and located at a side of the first rack. The chamber includes an inlet, a first sidewall, and a second sidewall. The first sidewall is adjacent to the first rack. The first sidewall has a plurality of vents. The first sidewall and the second sidewall are disposed to face each other. A width is spaced between the first sidewall and the second sidewall, and the width is larger than or equal to 200 mm. The fan is disposed in the housing for generating airflow to the inlet.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows:

FIG. 1 is a schematic diagram of a heating furnace according to an embodiment of the disclosure.

DETAILED DESCRIPTION

Reference will now be made in detail to the present embodiments of the disclosure, examples of which are illustrated in the accompanying drawings. Wherever possible, the same reference numbers are used in the drawings and the description to refer to the same or like parts.

FIG. 1 is a schematic diagram of a heating furnace 1 according to an embodiment of the disclosure. The structures and functions of the components included in the heating furnace 1 and the connections relationships among the components are introduced in detail below.

As shown in FIG. 1, in the embodiments, the heating furnace 1 includes a housing 10, a first rack 12*a*, a chamber 14, and fans 16. The first rack 12*a* is disposed in the housing 10. The chamber 14 is disposed in the housing 10 and located at a side of the first rack 12*a*. The chamber 14 includes an inlet 140, a first sidewall 14*a*, and a second sidewall 14*b*. The first sidewall 14*a* of the chamber 14 is adjacent to the first rack 12*a*. The first sidewall 14*a* and the second sidewall 14*b* of the chamber 14 are disposed to face each other. The first sidewall 14*a* of the chamber 14 has a plurality of vents 142. A width W is spaced between the first sidewall 14*a* and the second sidewall 14*b* of the chamber 14, and the width W is larger than or equal to 200 mm. The fans 16 are disposed in the housing 10 for generating airflows to the inlet 140.

It is noted that in the embodiment, a maximum static pressure of the fans 16 is smaller than 120 pa, and the wind velocities of the airflows are larger than 3 m/s. Therefore, the airflows can form a fluid balance with high static pressure after entering the chamber 14. That is, with the foregoing structural configuration, the static pressures at all places in the chamber 14 are the same, so the wind velocities of airflows flowed out of the vents are the same.

It can be seen that the heating furnace 1 of the embodiment has a simple structure, and the purpose of making the wind velocities of airflows flowed out of the vents be the same can be achieved by designing a predetermined width (i.e., the width W) needed to kept between the first sidewall 14*a* and the second sidewall 14*b* of the chamber 14 in advance and collocating the fans 16 capable of providing a predetermined static pressure. As a result, the heating furnace 1 of the embodiment can omit the additionally equipped wind control structures of the conventional heating furnace for achieving the foregoing same purpose.

As shown in FIG. 1, in the embodiment, the heating furnace 1 further includes a second rack 12*b*. The second rack 12*b* is disposed in the housing 10. The second sidewall 14*b* of the chamber 14 is adjacent to the second rack 12*b*, and the second sidewall 14*b* has vents 142 similar to the vents 142 of the first sidewall 14*a*. With the structural configuration, the heating furnace 1 of the embodiment can expand the temperature control range to at least two sides (i.e., where the first rack 12*a* and the second rack 12*b* are) of the chamber 14, so as to achieve the purpose of increasing the number of DUTs (Device Under Test) 2 by the single chamber 14.

In the embodiments, the number of the fans 16 is two, and the fans 16 are respectively disposed over the first rack 12*a* and the second rack 12*b*. The heating furnace 1 further includes a guide plate 19. The guide plate 19 is disposed between the fans 16 and has two guiding surfaces 190. The airflow generated by each of the fans 16 flows toward the corresponding guiding surface 190 and is guided to the chamber 14. Besides the function of guiding the airflows, the guiding plate 19 can achieve the effect of uniformly dispersing the airflows.

In particular each of the guiding surface 190 is a concave surface. Each of the concave surfaces has a radius of curvature, and the radius of curvature is larger than or equal to 175 mm. Hence, the airflows can be prevented from accumulating too much pressure loss while changing directions.

As shown in FIG. 1, in the embodiment, both of the first rack 12*a* and the second rack 12*b* include pluralities of carrying frames 120. The carrying frames 120 are parallel to a horizontal direction H and separately arranged along a vertical direction V. Each of the carrying frames 120 carries a DUT 2 (e.g., NAND flash memory) thereon. In addition, the chamber 14 further includes a plurality of nozzles 144. The nozzles 144 are respectively connected to the vents 142 of the first sidewall 14*a* and the second sidewall 14*b*. An extending direction of each of the nozzles 144 is parallel to the horizontal direction H and substantially aligned with a space over the corresponding carrying frame 120 (i.e., aligned with the corresponding DUT 2).

In particular, each of the nozzles 144 has a length L in the horizontal direction H, and the length L is larger than 20 mm. Hence, the traveling directions of the airflows flow out of the nozzles 144 can be kept to be parallel to the extending direction (and the foregoing horizontal direction H).

In an embodiment, the shape of each of the vents 142 is rectangular with 5 m×50 mm in size, but the disclosure is not limited in this regard.

The heating furnace 1 of the embodiment further includes two heaters 18. Each of the heaters 18 is disposed in the housing 10 and substantially located between the corresponding fan 16 and the inlet 140 of the chamber 14, so as to increase the temperature (e.g., 38° C.) of the airflows in the housing 10. Hence, after flowing out of the chamber 14 from the nuzzles 144, the heated airflows can flow toward the DUTs 2 on all of the carrying frames 120, so as to perform a burning test to the DUTs 2 at the same temperature (e.g., 80±3° C.).

As shown in FIG. 1, in the embodiment, the housing 1 of the heating furnace 1 has a top board 100. A top passage 100*a* is formed between the top board 100 and the first and second racks 12*a*, 12*b*. The fans 16, the guiding plate 19, and the heaters 18 are located in the top passage 100*a*. In addition, the housing 10 of the heating furnace 1 further has a first side board 102 and a second side board 104. The first rack 12*a* is located between the first side board 102 and the chamber 14, and a first side passage 102*a* is formed between the first side board 102 and the first rack 12*a*. After flowing out of the nozzles 144 on the first sidewall 14*a*, the airflows flow through the spaces over the carrying frames 120 (i.e., through the DUTs 2) of the first rack 12*a*, the first side passage 102*a*, and then return to the fan 16 over the first rack 12*a*. Relatively, the second rack 12*b* is located between the second side board 104 and the chamber 14, and a second side passage 104*a* is formed between the second side board 104 and the second rack 12*b*. After flowing out of the nozzles 144 on the second sidewall 14*b*, the airflows flow through the spaces over the carrying frames 120 (i.e., through the DUTs 2) of the second rack 12*b*, the second side passage 104*a*, and then return to the fan 16 over the second rack 12*b*. It can be seen that the heating furnace 1 of the embodiment can implement at least two circulation paths of airflow by the single chamber 14 in the housing 10.

In an embodiment, the housing 10 of the heating furnace 1 can further include cooling holes (not shown), so as to prevent the temperature inside the heating furnace 1 from overheat.

Accordingly, the heating furnace of the disclosure can achieve the purpose of making the wind velocities of airflows flowed out from the vents be the same by making the width between the first sidewall and the second sidewall of the chamber 14 be larger than or equal to 200 mm and making the maximum static pressure of the fans be smaller than 120 pa. In addition, the heating furnace of the disclosure forms vents on the first sidewall and the second sidewall of the chamber, so that the temperature control range can be expanded to at least two sides of the chamber, and the single chamber can achieve the purpose of increasing the number of DUTs. Furthermore, the heating furnace of the disclosure can guide and uniformly disperse airflows by the guiding plate, and the guiding plate collocates the top passage the first side passage, and the second side passage formed by the housing and the first and second racks can implement at least two circulation paths of airflow by the single chamber in the housing.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A heating furnace, comprising:

a housing;

a first rack disposed in the housing;

a chamber disposed in the housing and located at a side of the first rack, the chamber comprising an inlet, a first sidewall, and a second sidewall, wherein the first sidewall is adjacent to the first rack, the first sidewall has a plurality of vents, the first sidewall and the second sidewall are disposed to face each other, a width is spaced between the first sidewall and the second sidewall, and the width is larger than or equal to 200 mm;

two fans disposed in the housing for respectively generating two airflows to the inlet;

a second rack disposed in the housing, wherein the second sidewall is adjacent to the second rack, the second sidewall has vents similar to the vents of the first sidewall, and the fans are respectively disposed over the first rack and the second rack; and a guide plate disposed between the fans and having two guiding surfaces, wherein the airflow generated by each of the fans flows toward the corresponding guiding surface and is guided to the chamber.

2. The heating furnace of claim 1, wherein a maximum static pressure of the fan is smaller than 120 pa.

3. The heating furnace of claim 1, wherein the vents are equal in size.

4. The heating furnace of claim 1, further comprising a heater disposed in the housing and substantially located between the fan and the inlet.

5. The heating furnace of claim 1, wherein each of the guiding surface is a concave surface and has a radius of curvature, and the radius of curvature is larger than or equal to 175 mm.

6. The heating furnace of claim 1, wherein the chamber further comprises a plurality of nozzles respectively connected to the vents of the first sidewall, and each of the nozzles has a length larger than 20 mm.

7. The heating furnace of claim 6, wherein the first rack comprises a plurality of carrying frames, the carrying frames are parallel to a horizontal direction and separately arranged along a vertical direction, an extending direction of each of the nozzles is parallel to the horizontal direction and substantially aligned with a space over the corresponding carrying frame.

8. The heating furnace of claim 7, wherein the housing has a side board, the first rack is located between the side board and the chamber, a side passage is formed between the side board and the first rack, and after flowing out of the nozzles, the airflow flows through spaces above the carrying frames and the side passage sequentially, and then flows back to the fan.

* * * * *